US007578414B2

(12) United States Patent
Sellars et al.

(10) Patent No.: US 7,578,414 B2
(45) Date of Patent: Aug. 25, 2009

(54) ALL WEATHER ABSORBENT TOWEL DISPENSER

(75) Inventors: John C. Sellars, Wauwatosa, WI (US); Jerry Ballas, Media, PA (US); Balbir Singh, Media, PA (US); Neal D. Watson, Fox Point, WI (US); Ronald A. Bogdanovich, Mequon, WI (US)

(73) Assignee: Sellars Absorbent Materials, Inc., Milwaukee, WI (US)

( * ) Notice: Subject to any disclaimer, the term of this patent is extended or adjusted under 35 U.S.C. 154(b) by 174 days.

(21) Appl. No.: 10/870,329

(22) Filed: Jun. 17, 2004

(65) Prior Publication Data

US 2005/0046314 A1 Mar. 3, 2005

(51) Int. Cl.
*B65D 83/00* (2006.01)
*B65D 25/54* (2006.01)
*B65H 1/00* (2006.01)

(52) U.S. Cl. ..... 221/65; 221/33; 221/63; 220/781

(58) Field of Classification Search ..... 221/33, 221/61, 63, 185, 64, 65, 66; 206/508, 511, 206/509, 494, 223, 503, 505, 510, 515, 215, 206/271, 270; 220/213, 297, 298, 623, 695, 220/781, 908

See application file for complete search history.

(56) References Cited

U.S. PATENT DOCUMENTS 2,017,176 A * 10/1935 Andrews ..... 229/131.1
2,317,102 A 4/1943 McKaig, Jr.
2,378,628 A * 6/1945 Gray ..... 220/555
3,179,323 A * 4/1965 Miller ..... 220/23.87
3,197,062 A * 7/1965 Day et al. ..... 221/48
3,224,633 A * 12/1965 Allen ..... 221/48
3,319,684 A * 5/1967 Calhoun ..... 604/326
3,349,956 A * 10/1967 Stephan ..... 206/508
3,836,045 A * 9/1974 Duhy et al. ..... 221/63
3,843,017 A 10/1974 Harrison
3,868,052 A 2/1975 Rockefeller (Continued)

FOREIGN PATENT DOCUMENTS

FR 2 549 362 A 1/1985

(Continued)

OTHER PUBLICATIONS

Sherwin-Williams advertisement at www2.sherwin-williams.com/newproducts.

(Continued)

*Primary Examiner*—Gene Crawford
*Assistant Examiner*—Rakesh Kumar
(74) *Attorney, Agent, or Firm*—Fredrikson & Byron, PA

(57) ABSTRACT

A water resistant absorbent towel dispenser. The dispenser includes a container having top, bottom and side walls housing a supply of absorbent towels, and an exterior handle for facilitating transport of the dispenser. The top wall includes a finger-accessible opening through which absorbent towels may be withdrawn. In certain embodiments, the top wall is convex upwardly, but is flexible to enable it to be depressed when dispensers are stacked vertically so as to come into load bearing contact with the towel supply. In some embodiments, the top and bottom walls have interlocking configurations to add lateral stability to vertically stacked dispensers.

2 Claims, 13 Drawing Sheets

U.S. PATENT DOCUMENTS 3,934,745 A * 1/1976 Lovell ..... 215/224
4,171,047 A * 10/1979 Doyle et al. ..... 206/210
4,219,129 A * 8/1980 Sedgwick ..... 221/63
4,328,907 A * 5/1982 Beard ..... 221/63
4,353,480 A * 10/1982 McFadyen ..... 221/63
4,437,589 A * 3/1984 Potter ..... 222/327
4,462,507 A 7/1984 Margulies
4,473,165 A * 9/1984 Lentjes ..... 220/659
4,506,784 A * 3/1985 Kanfer ..... 206/77.1
4,534,491 A * 8/1985 Norton et al. ..... 221/63
4,615,442 A 10/1986 Beeken
4,651,895 A * 3/1987 Niske et al. ..... 221/63
4,723,684 A * 2/1988 Lambert et al. ..... 220/268
4,800,842 A * 1/1989 Jones, Jr. ..... 119/168
4,863,064 A * 9/1989 Dailey, III ..... 221/48
4,930,644 A * 6/1990 Robbins, III ..... 215/382
4,934,570 A * 6/1990 Bamberger et al. ..... 222/386
D316,789 S 5/1991 McLaughlin
5,037,000 A 8/1991 Selame et al.
D327,798 S 7/1992 Addison et al.
D327,799 S 7/1992 Addison et al.
5,207,367 A * 5/1993 Dunn et al. ..... 225/49
5,379,897 A * 1/1995 Muckenfuhs et al. ..... 206/494
5,383,550 A * 1/1995 Tsao ..... 206/5.1
5,409,126 A * 4/1995 DeMars ..... 220/4.27
5,467,893 A * 11/1995 Landis et al. ..... 221/34
5,507,389 A * 4/1996 Syrek ..... 206/508
5,535,910 A * 7/1996 Cassel ..... 220/212
D372,615 S 8/1996 Owens
5,573,118 A * 11/1996 Cramer et al. ..... 206/505
D381,162 S * 7/1997 Berend et al. ..... D34/11
5,740,914 A * 4/1998 Herzog ..... 206/501
5,769,229 A * 6/1998 Andress et al. ..... 206/505
5,803,249 A * 9/1998 Harsanyi et al. ..... 206/233
5,896,987 A * 4/1999 Bettenhausen ..... 206/370
5,900,293 A * 5/1999 Zettle ..... 428/12
6,000,538 A * 12/1999 Lee ..... 206/233
6,056,142 A * 5/2000 Elliott ..... 220/278
6,056,235 A 5/2000 Brozinsky
6,070,756 A * 6/2000 Dodge et al. ..... 221/52
6,123,196 A * 9/2000 Chiu ..... 206/508
6,158,614 A * 12/2000 Haines et al. ..... 221/63
6,220,435 B1 * 4/2001 Nobile et al. ..... 206/409
6,250,490 B1 * 6/2001 Loftus ..... 220/23.4
6,273,291 B1 * 8/2001 Conti ..... 220/781
6,279,775 B1 8/2001 Parkes et al.
6,321,937 B1 11/2001 DeSimone et al.
6,364,101 B1 * 4/2002 Schultz ..... 206/210
6,381,981 B1 * 5/2002 Yaddgo et al. ..... 62/372
6,409,034 B2 * 6/2002 Schorner ..... 215/237
6,412,634 B1 * 7/2002 Telesca et al. ..... 206/494
6,412,656 B1 * 7/2002 Placik ..... 221/33
D467,106 S 12/2002 Bohay
6,554,156 B1 4/2003 Chong
6,607,514 B2 8/2003 Reese
6,786,351 B2 * 9/2004 Krueger ..... 220/571
6,796,430 B2 * 9/2004 Mercier et al. ..... 206/505
6,889,867 B1 * 5/2005 Smith ..... 221/33
2003/0116582 A1 6/2003 Tosdale
2003/0150868 A1 * 8/2003 Hewett ..... 221/65

FOREIGN PATENT DOCUMENTS

NL 8 101 850 A 11/1982

OTHER PUBLICATIONS

"Rags in a Box" product of Kimberly Clark, seven color photographs.

* cited by examiner

ALL WEATHER ABSORBENT TOWEL DISPENSER

BACKGROUND

Disposable absorbent wipers/towels have many uses. Disposable wipers/towels are particularly popular with do-it-yourself homeowners and trades people who find wipers valuable for cleaning tools, work areas and their hands. Disposable wipers are also used frequently in factories, on farms and in the boating industry (both commercial and recreational). These are just a few of the wide variety of people and multitude of uses of disposable wipers. Frequently, disposable wipers are used by people who are on the go, whether it be trades people moving from job to job, maintenance people moving from machine to machine within a factory or farmers dealing with issues wherever they come up. Containers of disposable wipers thus are often treated as valuable items of one's normal equipment for performing jobs and are often carried in the back of trucks to job sites along with other tools or on maintenance carts in factories. Disposable wiper containers end up in countless types of places, wherever people do work.

Often, because these containers can be used and stored outside, they can become exposed to inclement weather or they can be indoors in dusty and dirty environments. Traditionally, disposable wipers have been packaged in cardboard boxes that are dispensed through an open hole in the top.

For convenience, absorbent towels commonly are provided as successive sheets on a continuous web wound in a roll with individual sheets separable from the roll by means of perforation lines established at pre-determined distances. The perforations allow a user to tear off a portion of the absorbent towel roll. Rolls of toweling may be housed in dispensers, such as cardboard boxes, that allow the user to access the towels, usually through a small opening provided in the top of the box.

A challenge associated with dispensing absorbent towels involves the ability to keep the towels dry and clean so that the effectiveness of the towels is not compromised, but enabling the towels to be easily accessed by a user. Cardboard box dispensers of the type currently available from Kimberly-Clark Corporation under its "Rags in a Box" trademark, can become water or oil soaked if exposed to the elements or placed on a wet or oily support, resulting in towels within the dispenser becoming contaminated with water or oily residue. Cardboard boxes themselves are susceptible to degradation, especially upon becoming wet. When towels within a box become water-soaked, dirty or oily, they become substantially useless and are discarded.

BRIEF SUMMARY OF THE INVENTION

The present invention provides an all weather absorbent towel dispenser that is mobile and water resistant. It is designed for easy dispensing and to be used in many harsh environments while keeping the wipers dry, clean and dust free. In various embodiments, the dispensers can be stably stacked with toweling rolls themselves in a unit sharing the weight of units stacked on it, can be resealed, and may be configured to be resistant to water and dirt.

In certain embodiments, a disposable towel dispensing unit is provided that comprises a water-resistant container having bottom, top and side walls and having a manually graspable exterior handle. A roll of dry, disposable towels is carried within the container, the top wall being vertically movable, upon application of an exterior force, to enable it to be depressed against and supported by the towel roll. An opening in the top wall of the container provides finger access to towels in the interior of the container.

In some embodiments, a disposable towel dispensing unit is provided that comprises a water-resistant container having bottom and side walls and an upwardly convex, vertically flexible top wall with an opening providing finger access to the container. The convex configuration of the top wall enables moisture and debris on the upper surface to be drawn away by gravity from the vicinity of the finger access opening. The container includes a manually graspable exterior handle. The unit includes a roll of towels having a generally vertical axis and a height sufficient to enable the roll to engage and support the top wall when the latter is depressed.

In further embodiments, a disposable towel dispensing unit is provided that comprises a water-resistant container having bottom and side walls and an upwardly convex top wall, the unit having a manually graspable exterior handle protruding from a side wall of the container, and the top wall having a central opening providing finger access to the interior of the container. The top wall and bottom wall have exterior surfaces with respective nesting or interlocking configurations facilitating stable vertical stacking of a plurality of the containers. Also, in certain embodiments, the top wall may be formed as a removable lid that has a periphery removably attached to the side wall so as to permit the entire top wall to be removed to provide access to the container.

In yet other embodiments, a disposable towel dispensing unit is provided that comprises a water-resistant container having a body comprising bottom and side walls and a lid forming a top wall, the lid being movably attached at its periphery to the body to enable the lid to vertically move as a unit with respect to the body, the lid having an opening sized to enable finger access to the container. A roll of absorbent toweling is housed within the container, the roll having a vertical axis and a height enabling it to be contacted in a load bearing relationship by the lid when another dispenser unit is stacked on the lid.

According to another aspect, a method of stacking a plurality of dry towel dispensing units is provided. The method includes providing a plurality of towel dispensing units each having top, bottom and side walls forming a water resistant container. The top wall of each unit has a ridge extending above its upper surface, and the bottom wall of each unit has a ridge-mating surface, such as a recessed shoulder, for receivably engaging the top wall ridge of another of the units. The method further includes vertically stacking the dispenser units to form interfaces between vertically adjacent units, the ridge-mating surface of one unit engaging the ridge of another of the units to form an interlock that restrains vertically adjacent units from slipping sideways with respect to each other.

DETAILED DESCRIPTION

The following detailed description should be read with reference to the drawings, in which like elements in different drawings are numbered identically. The drawings depict exemplary embodiments and are not intended to limit the scope of the invention.

Figure 1:
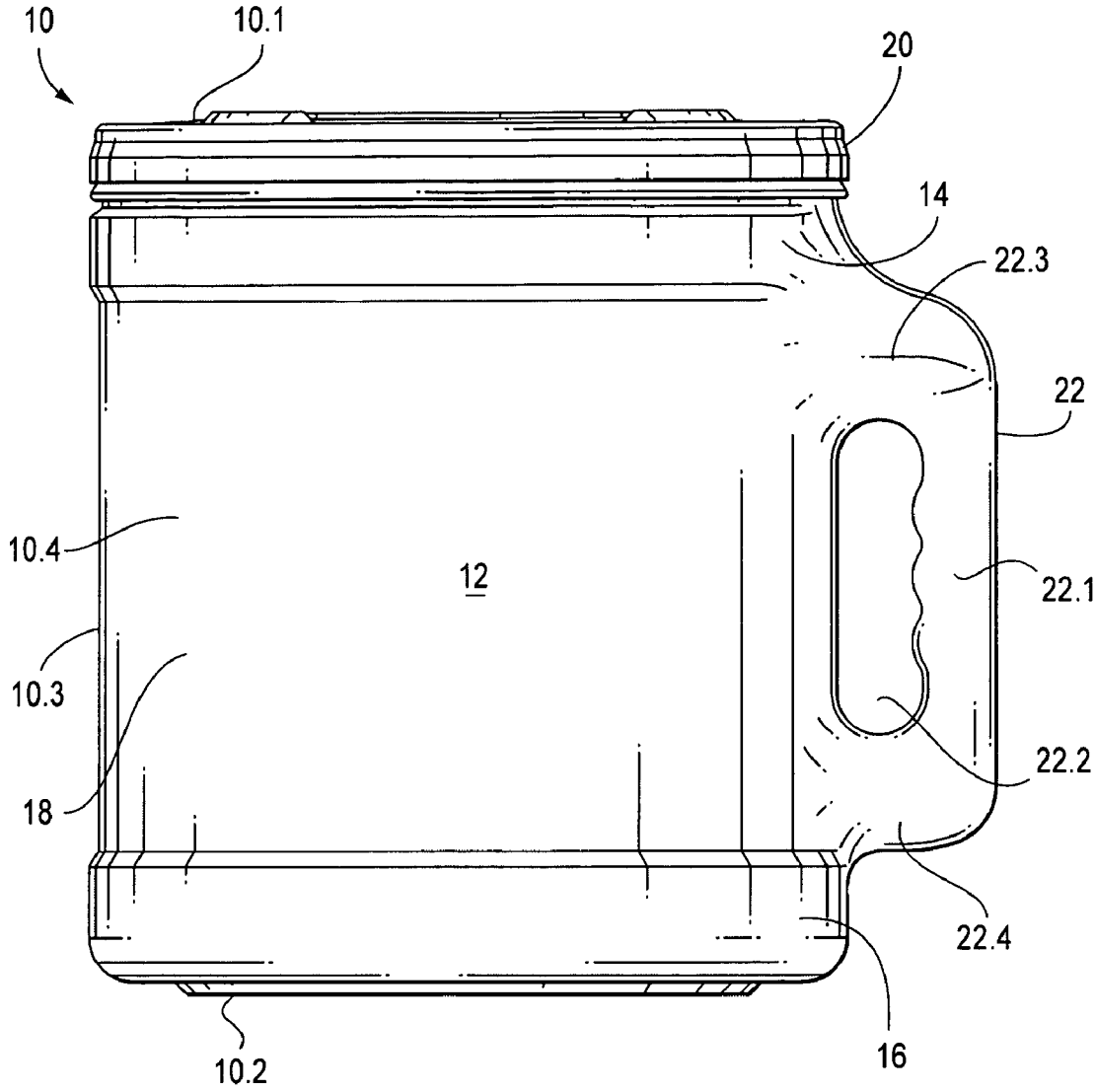
FIG. 1 is a side view of an absorbent towel dispenser unit.

In the embodiments typified in FIG. 1, a dispenser unit 10 has top, bottom and side walls 10.1, 10.2, 10.3, respectively, forming a water-resistant container 10.4. The container may be formed with a main body 12 having top and bottom portions 14, 16 and a middle portion 18, the bottom portion comprising the bottom wall 10.2. The main body can be formed of a unitary construction, e.g;, by known plastic blow molding or other molding techniques. A lid 20 is removably attached to the top portion of the body, and provides the top wall of the container. Lid 20 (shown in detail in FIG. 3) may be removably attached to the top portion of the body in various ways, such as through the use of a peripheral threaded connection or through the use of complementary circumferential grooves or beads enabling the lid to be snapped onto the top body portion. Removal of the lid exposes the interior of the container sufficiently to enable a supply of toweling to be inserted. In another embodiment (not shown), the lid may be moved to the bottom of the dispenser 10 to act as a bottom closure. The connection of the lid to the body may be water resistant.

Figure 4:
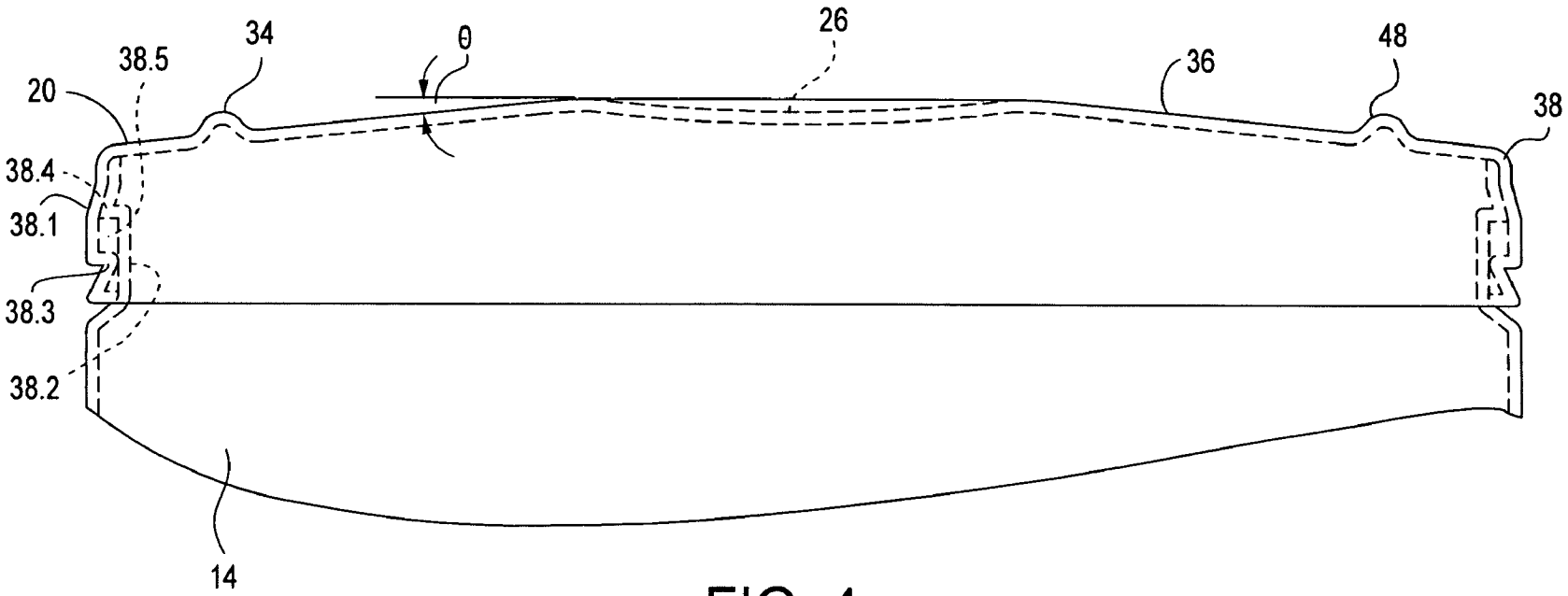
FIG. 4 is a cut-away side view of the lid shown in FIGS. 1 and 3.

A movable connection of the lid to the body is depicted in FIG. 4. The periphery 38 of the lid may have an annular, down-turned portion 38.1 that is received over the upper annular portion 38.2 of the body. Portion 38.1 may have an annular inwardly protruding bead 38.3 near its lower end, and body portion 38.2 has an annular, exteriorly protruding bead 38.4 that interlocks with the bead 38.3 when the lid is received on the body. The beads are formed so as to provide a vertical gap 38.5 between them when the lid is fully received on the body, as shown in FIG. 4. The lid is thereby able to move upwardly as a unit with respect to the body, the gap 38.5 closing as bead 38.3 moves toward bead 38.4. As shown, the beads may have tapered engaging surfaces to enable the lid to be easily snapped onto the body. Vertical movement of the lid with respect to the body may serve to enable the container to accommodate rolls of toweling having slightly different heights, and also may enable the lid to be depressed into load-bearing contact with the upper end of a toweling roll when the units are stacked.

The container 10.4 is illustrated in the drawings as being generally cylindrical in shape, and this configuration is spatially efficient to house a roll of towels having a vertical axis and also is economical as regards container material costs. However, the container may have other shapes as desired.

The dispensing unit 10 further includes an exterior handle 22 to facilitate transport and use of the unit. The handle 22 is exemplified as having a generally rectangular cross-section and is formed to extend beyond the outer surface of the main body 12. The handle may be formed in any shape and geometry, and may be joined to the side wall, as illustrated, or may be attached elsewhere to the of the container, as at or near the top or bottom of the container. The handle may be formed in a round or curved configuration or may formed so that it does not extend substantially beyond the outer surface of the main body 12. In the latter case, a portion of the main body 12 may extend inward of the container, forming an indentation or pocket in which the handle extends. In another configuration, the handle can be formed to exclude an open, interior space and rather be formed as a graspable extension protruding from the main body 12.

Handle 22 may be constructed so that a user may grasp it with ease. In certain embodiments, the handle itself may have a generally vertical portion 22.1 that may be tubular and may be spaced from the adjacent side wall of the container to provide an opening 22.2 into which one may easily insert the fingers of the hand when grasping the portion 22.1. The opening 22.2 may be made large enough to accommodate the gloved hand of a user. In certain embodiments, the distance between the side wall of the container and the tubular portion 22.1 of the handle, may range from about 0.75 inches to about 2.5 inches so that gloved fingers are able to extend through the opening. In another embodiment, this width may be about 1.5 inches.

Additionally, the handle 22 may be large enough and strong enough to distribute the weight of the dispenser unit with its supply of absorbent towels so that the dispenser can be grasped firmly and stably and without significant sagging or distortion of the container. For example, the height of the handle opening may be large enough (as described above) so that all four fingers of a gloved human hand are able to extend through it, enabling the user to firmly grasp and manage the weight of the dispenser. For example, in one embodiment, the handle opening height ranges from about 3 inches to 5 inches. In yet another embodiment, the height is about 4 inches. Although the tubular portion 22.1 of the handle 22 is shown attached for strength at both its top and bottom to the side wall of the container, either the top or the bottom attachment 22.3, 22.4 of the tubular portion 22.1 could be eliminated if desired. When the unit is held upright by the handle, the upper connection 22.3 is generally in tension and the lower connection 22.4 is in compression, and eliminating either of these connections will subject the other connection to additional stress, perhaps requiring additional material to be used. Tubular portion 22.1 may be formed with rounded edges, as illustrated, for comfort and to decrease stress concentrations when the unit is supported by the handle.

Although the dimensions of the dispenser can vary, the overall weight of the towels and container may be significant. For example, the weight of the unit in some embodiments may range from about 1 to about 4 pounds, with the roll of towels weighing about 3 pounds. Dimensioning the handle as exemplified above may improve the ease with which the dispenser unit may be held as a towel is removed or as the unit is transported.

The main body 12 includes a middle portion 18 that is recessed relative to the top and bottom portions 14, 16. The middle portion may have a smooth surface or be embossed with marketing or decorative lettering and/or designs. Alternately, a paper-type label may be affixed to the middle portion. Likewise, the top 14 and bottom portions 16 may include embossments, decals, or other decorative or marketing material. Because the middle portion 18 is recessed and thus is protected somewhat by the top and bottom portions, labels affixed to the recessed middle portion are less susceptible to wear and tear during packaging, transport, and use.

Figure 2:
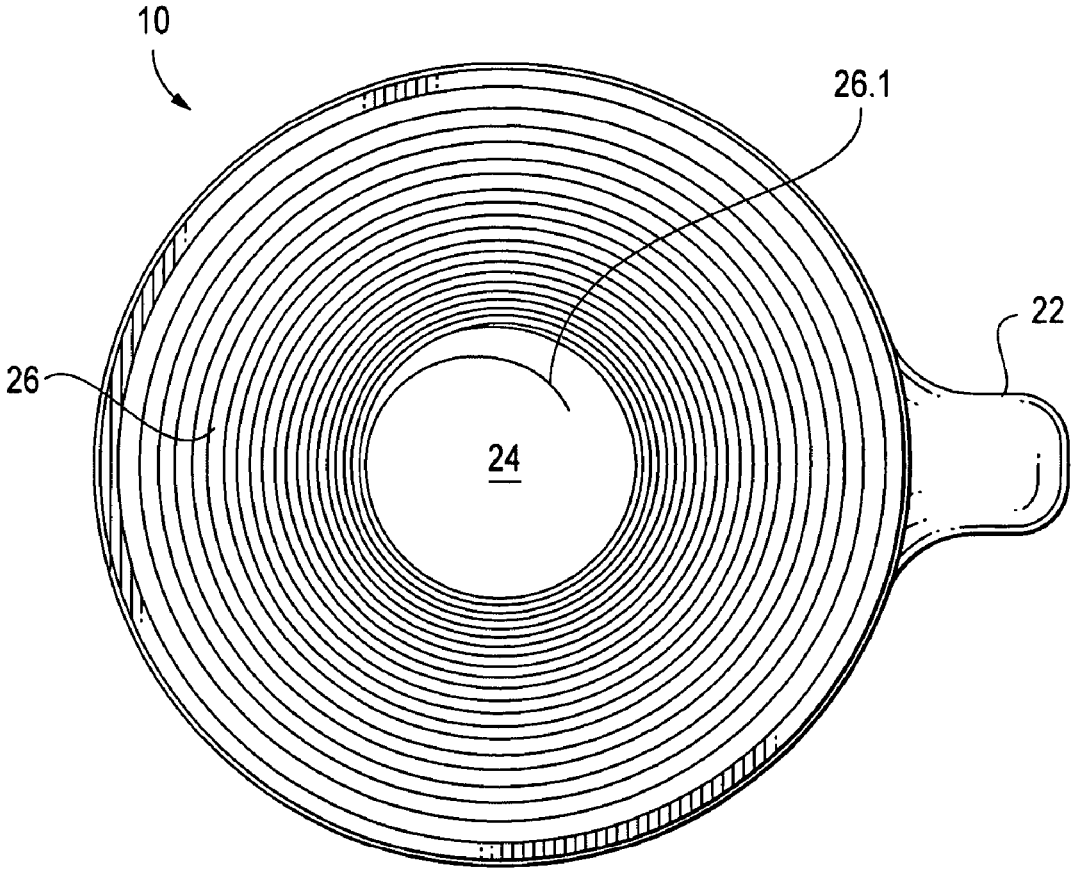
FIG. 2 is top view of the dispenser unit of FIG. 1 shown with the lid removed.

FIG. 2 is a top view of a dispenser unit 10 shown with the lid removed. A continuous roll of toweling 26 is shown in the interior 24 of the container. The absorbent material may be made from either a woven or nonwoven material. There are a wide variety of nonwoven processes and they can be either wetlaid or drylaid. Some examples are hydroentagled (sometimes called spunlace), DRC (double re-creped), airlaid, spunbond, and meltblown materials, ect. "Toweling", as used herein, refers in general to sheet or web-like materials that may be absorbent and that may be provided in roll form. Sometimes referred to as "wipes" or "wipers", the toweling may have perforations (not shown) extending in lines across its width to separate individual toweling sheets and facilitate separation or tearing of individual sheets from the roll. Individual sheets may be sized as desired to accommodate the many uses of the towels. For example, perforation lines may be formed every 13 inches to define a universally sized towel. Multiple perforation lines may be provided to allow the user to select the size of towel depending on the particular need.

A roll of toweling may be provided without a central core so that a free end 26.1 in the center portion of the roll is accessible. The roll is positioned with its axis extending vertically, and the roll of toweling is consumed from its center to its outside. The toweling roll may be of any size to fit within the dispenser. In one embodiment, the diameter of the roll ranges from about 6 to about 12 inches. In other embodiments, a roll may have a diameter of approximately 8 inches or of approximately 10 inches.

The height of the roll of toweling may be selected to provide vertical crushing support and strength for the dispenser. Lid 20, forming the top wall 10.1 of the container, may be constructed of a lightweight, flexible material so that the weight of an upper dispenser unit that is stacked on a lower dispenser depresses the top wall of the lower dispenser. In one embodiment, as shown in FIG. 8*b*, the height of the toweling roll is such that the roll extends from the bottom of the dispenser 10 to or nearly to the underside of the 10.1. When one dispenser unit is stacked on another dispenser unit, the top wall 10.1 of the lower unit is caused to deflect downward into contact with the top 26.2 of the towel roll carried in the lower container. In these embodiments, the weight of the upper unit or units is shared by the side wall of the container and by the roll of towels within the container. The towel roll serves to bear a portion of the load, and this adds vertical crushing strength to a vertical stack of the units. This load-bearing feature may be considered when determining the needed vertical crush strength of side walls of the container, and may result in container material savings.

Figure 3:
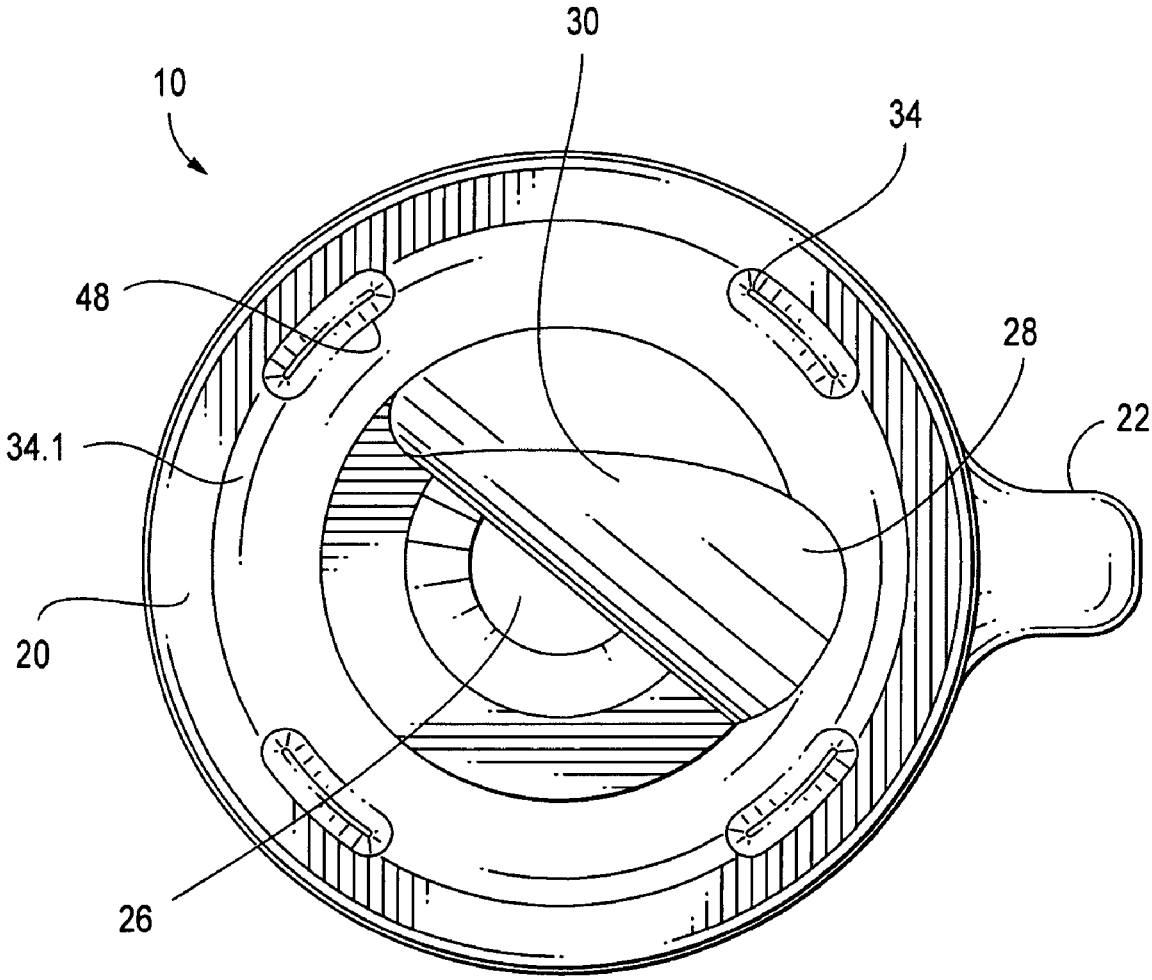
FIG. 3 is a top view of the dispenser unit of FIG. 1 shown with the lid attached.

FIG. 3 is a top view of the dispenser 10 with the lid 20 in place. Lid 20 substantially covers the opening to the interior of the container. Lid 20, defining the top wall 10.1, includes an opening 26 through which absorbent material 26 is dispensed. In use, the free end of the web is pulled from the interior of the dispenser 10 through the opening 26. The opening may be sized to provide finger access to the container, that is, so that human fingers (for example, the thumb and index finger) can extend through the opening to grasp the absorbent material 24. To thus enable finger access to the container, the diameter of the opening 26 may range from about 1 inch to about 2.5 inches. The size of the opening 26 should, however, be limited so as to control the area through which debris and moisture may enter the dispenser 10 and soil the absorbent material.

Figure 5A:
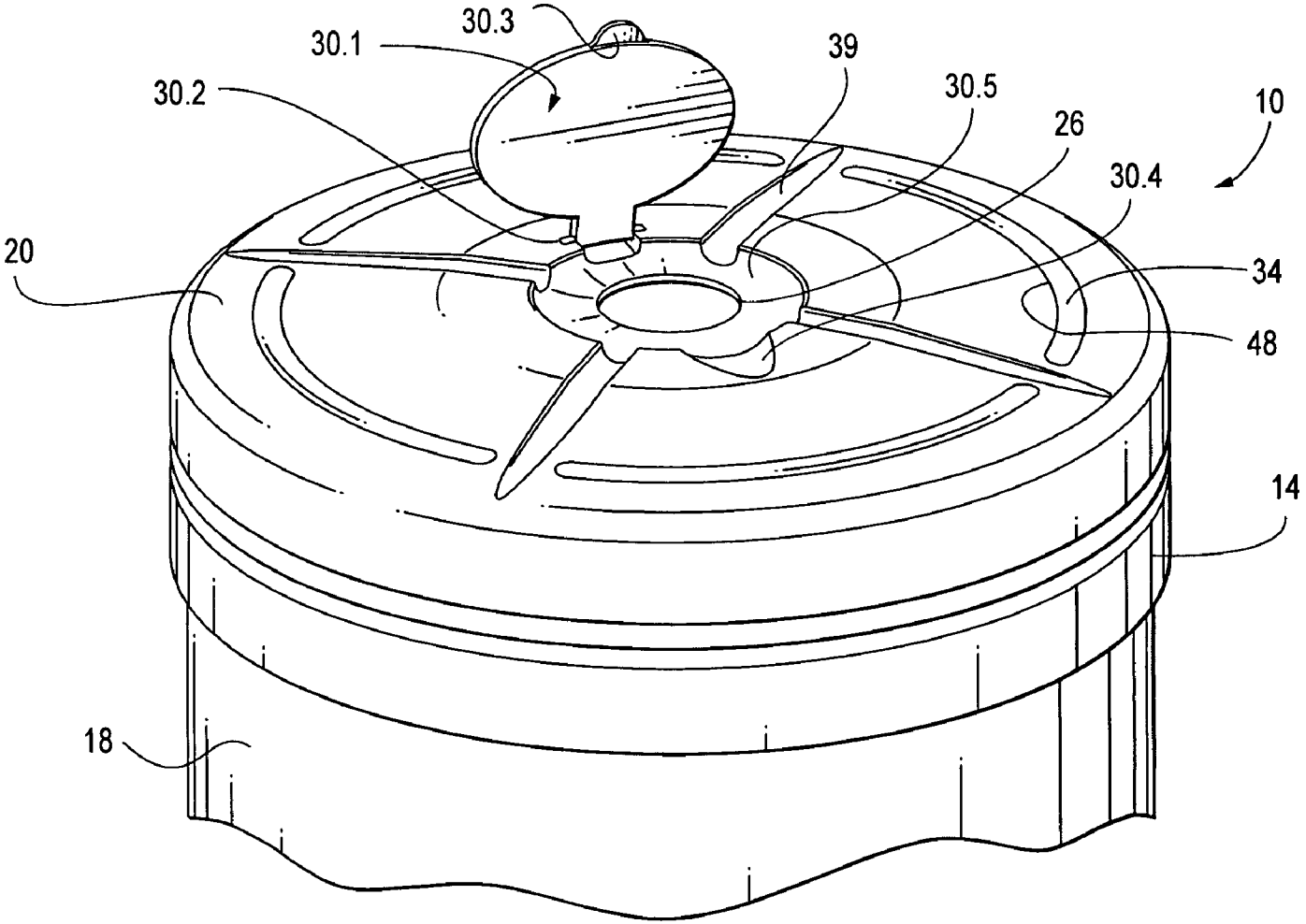
FIG. 5*a* is top perspective view of an alternate embodiment of the lid.

To improve the water tightness of the container 10.4, opening 26 may be covered with an openable cover. As depicted in FIG. 3, the cover is shown as a flexible sheet 28 that can be peeled back to reveal the opening 26. The cover 28 may include logos or decorative or marketing material, and may be formed of any suitable waterproof material, such as plastic or wax coated paper or plastic. The backside 30 of the cover (the side contacting the lid 20) may be coated with a repositionable pressure-sensitive adhesive enabling the cover to be repeatedly affixed and removed from the surface of the lid surrounding the opening 26. As depicted in FIG. 5*a*, the cover may take the form of a closable cap 30.1 that is attached to the lid by a hinge 30.2. Various snap-on or screw-on type caps may be used as desired.

During use, the user removes the cover 28 to reveal the opening 26. If necessary, the user inserts his or her fingers through the opening 26 to access the free end of the absorbent material and pulls the same upwardly through the opening 26. In some cases, the free end may already protrude outward through the opening. To dispense individual sheets, the user may pull the web upward until a desired length of material is available and then tear off that length from the roll by means of the perforation lines. Edge 32 of the opening 26 may be used to facilitate tearing of the toweling roll at the perforation line.

Referring to FIGS. 3 and 4, small ridges 34 may extend above the surface of the lid 20 in one or more discontinuous annular rings. FIG. 3 depicts four ridge segments 34, however, more or fewer segments may be employed. The ridge segments may be formed during molding of the lid, and the segments have a raised inner edge 48. The openings between adjacent ridge segments provide channels 34.1 through which moisture and debris can move away from the opening 26. In the embodiment shown in FIG. 3, the four ridge segments 34 form a discontinuous circle of 360°. The total perimeter of that discontinuous circle that is occupied by the area of the ridge 34 is approximately 120°, leaving 240° of the ring unobstructed for moisture and debris to move under gravity away from the opening 26.

Referring now to FIG. 4, the top wall of the container formed by the lid is convex upwardly when the lid bears no load, e.g., it does not support the weight of another dispensing unit. The upper surface 36 of the lid slopes downward from the opening 26 toward the outer lid perimeter 38. The slope should be great enough so that moisture or debris present on the lid tends to move under gravity toward the outer perimeter 38 and away from the opening 26. The pitch angle θ of the slope in the vicinity of the opening 26 may range from about 2° to about 9° depending on the desired magnitude of slope. In further embodiments, the angle θ can range from about 4° to about 7°.

Figure 5B:
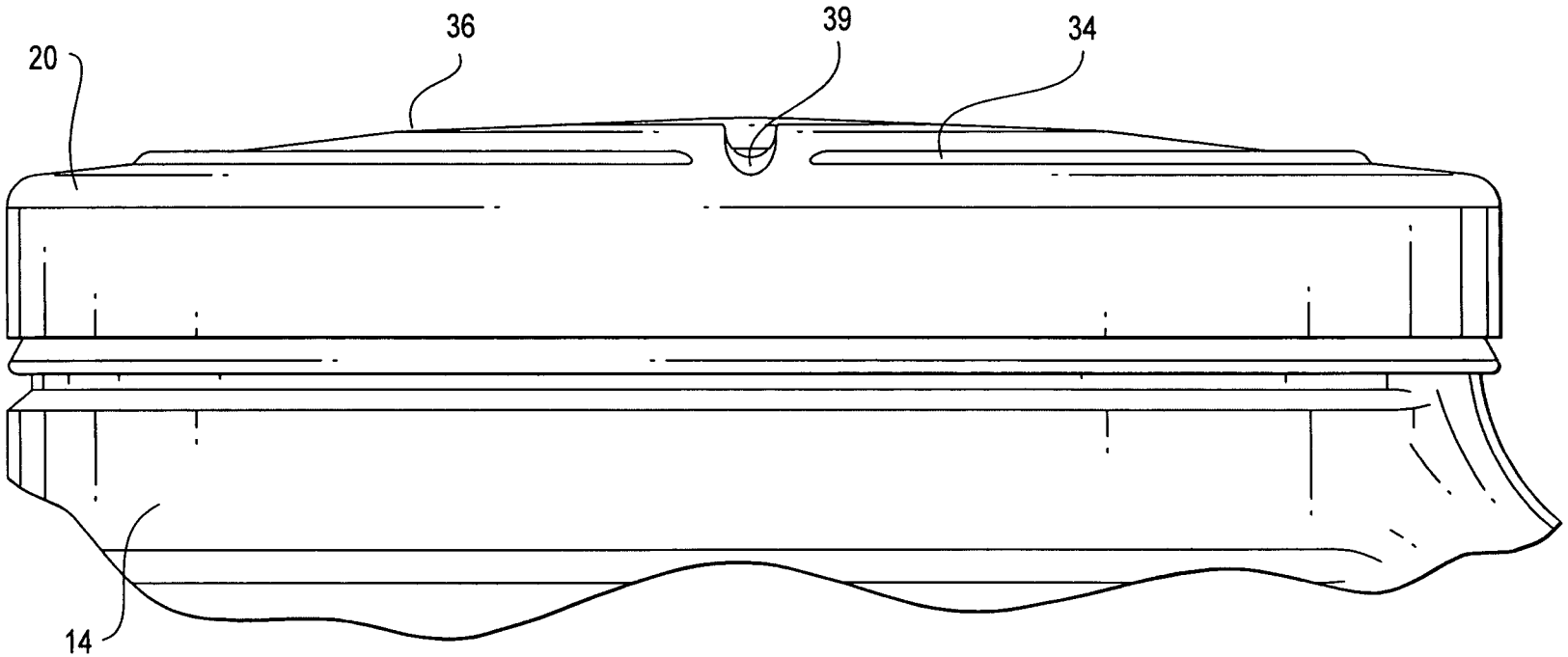
FIG. 5*b* is a side view of the lid embodiment depicted in FIG. 5*a;*
Figure 10:
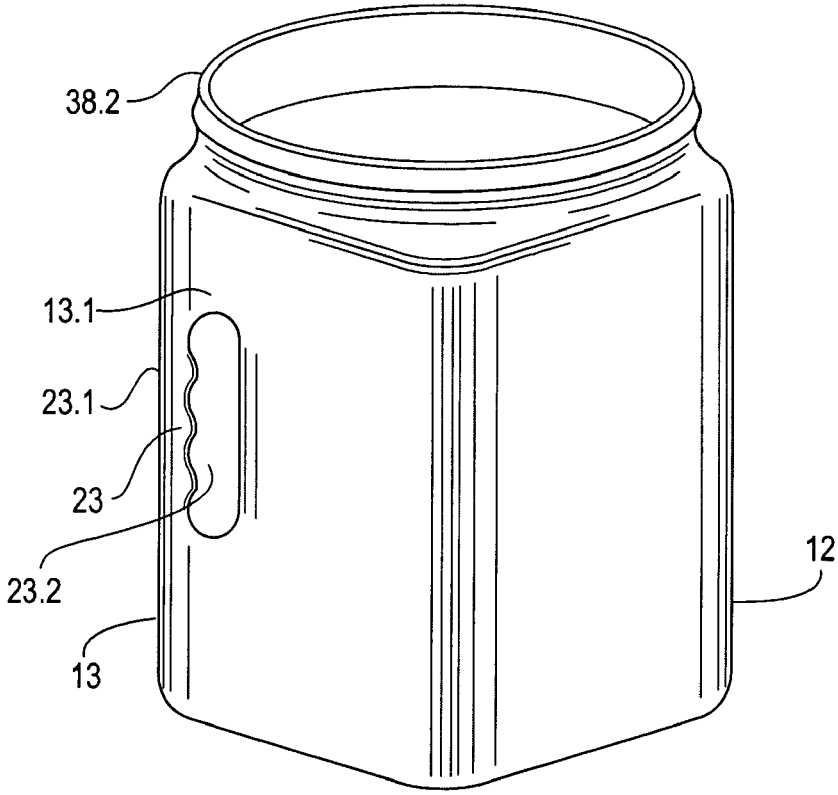
FIG. 10 is a perspective view of a modified embodiment of the body of a dispenser unit container.
Figure 11:
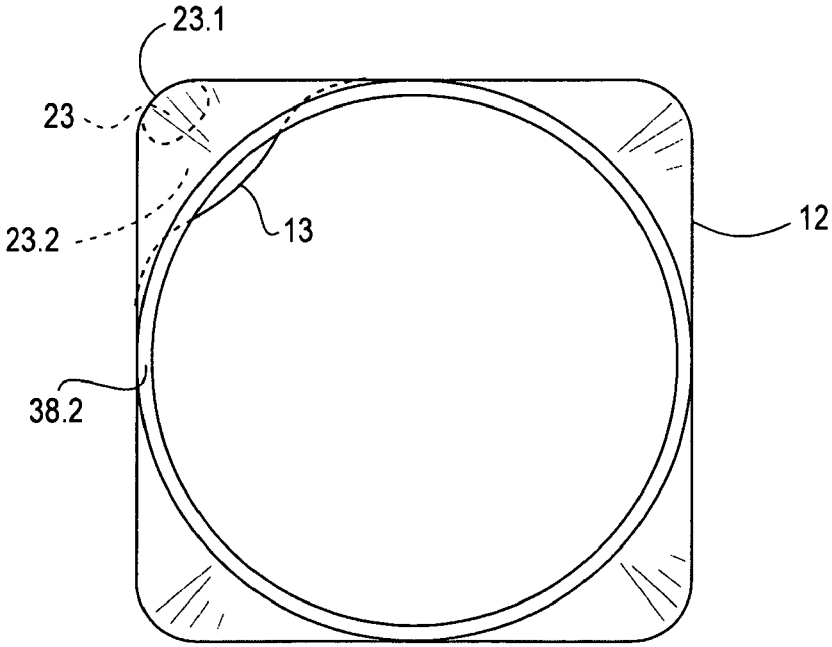
FIG. 11 is a top view of the container body shown in FIG. 10.

FIGS. 5*a* and 5*b* illustrate an embodiment similar to that of FIG. 4, the lid having an upwardly convex configuration, at least when not bearing the weight of another dispenser unit or other object, the lid being provided with ridge segments 34 that are generally longer than those depicted in FIG. 3. A central opening 26 provides finger access to the interior of the container. In this embodiment, the lid is provided with recesses or grooves 39 that extend radially outward towards the outer perimeter, the grooves being positioned between adjacent ridge segments to thus deepen and further define the channels 34.1. Although the illustrated embodiment has four grooves 39, any appropriate number of grooves could be used. With particular reference to FIG. 5*b*, grooves are shown as extending to the outer perimeter of the lid 20 for the purpose of diverting water more completely off the surface of the lid. Although the container 10.4 has been described in connection with other drawing figures showing the container body as being generally cylindrical, the body may have other configurations as desired. For example, FIGS. 10 and 11 depict the container body 12 as having a generally cubic configuration while retaining its upper annular portion 38.2 to receive a lid of the type described in connection with FIGS. 3, 4, 5*a* and 5*b*. FIG. 11 illustrates that the side walls of the body combine to yield a nearly square configuration when viewed from the top, with the corners of the square being rounded. A side wall corner 13 is indented for a portion of its height, as shown at 13.1, and a handle 23 carried by the body is provided in the indentation, the handle being formed to provide an opening 23.2 between it and the confronting surface of the side wall to receive the fingers. For ease of visualization, FIG. 11 depicts the indented side wall portion 13 as protruding slightly into the opening defined by the upper annular portion 38.2, but side wall portion 13 may be vertically aligned with the portion 38.2 so that a roll of toweling having a diameter approximating that of the upper annular portion may be received in the container body.

As a space saving feature, the outer surface 23.1 of the handle may extend outwardly approximately no further than the corner 13 of the body. In this configuration, dispenser units comprising containers of the configuration shown in FIGS. 10 and 11 may be stacked as closely as cylindrical containers. Although only one handle is shown in FIGS. 10 and 11, and elsewhere in the drawing, it should be appreciated that two or more handles may be provided as desired. When the container is configured as in FIGS. 10 and 11, a pair of handles may be formed as described above on corners spaced diagonally from each other across the center of the container.

The container 10.4 can be formed of waterproof or water-resistant materials such as polymers and particularly thermoplastic materials, or of paperboard materials coated or impregnated with a wax or a polymeric sealant. Since the dispenser units may be used in outdoor or other rugged environments such as garages, warehouses, or factories where moisture and debris are prevalent, water-resistant construction advantageously excludes moisture and debris from the interior of the dispenser 10 for the purpose of keeping the towel supply clean and dry. The container 10.4, when made of plastic, can be manufactured by blow molding, injection molding or by other techniques known in the art, and may be formed with the handle 22 as an integral piece to increase both the strength of the handle and the water tightness of the dispenser. The handle could be attached to the body 12 after molding as long as the resulting product remains waterproof. The juncture of the handle with the remainder of the body of the container may be rounded to promote ease of molding and to avoid stress concentration. Handle 22 may be hollow, and its interior may communicate with the interior of the container as when the body and handle are formed by blow molding or other molding techniques, provided that the container itself remains water resistant. The lid portion may be separately molded, as by injection molding of thermoplastic polymers, or may otherwise be formed, and may be made of the same or similar materials as the body of the container or of different materials. When provided with a cap, such as that shown at 30.1 in FIG. 5*a*, the lid may be formed, e.g., molded, with appropriate slots or other openings adjacent the central opening 26 to receive a hinge pin 30.2. The cap 30.1 may have a tab 30.3 to enable it to be pried up from the lid, and the lid may have a tab-shaped depression 30.4 in which the tab is received. Note further that the lid may be recessed slightly, as shown at 30.5, to accommodate the cap.

As explained further below, the dispenser unit lid itself may be sufficiently flexible to enable it to be elastically compressed or deflected downward from its normal convex configuration when the unit is subjected to a vertical load, as when one or more other dispensing units are stacked on top of it. When the unit is relieved of its vertical load, the lid resumes its convex configuration.

Figure 6:
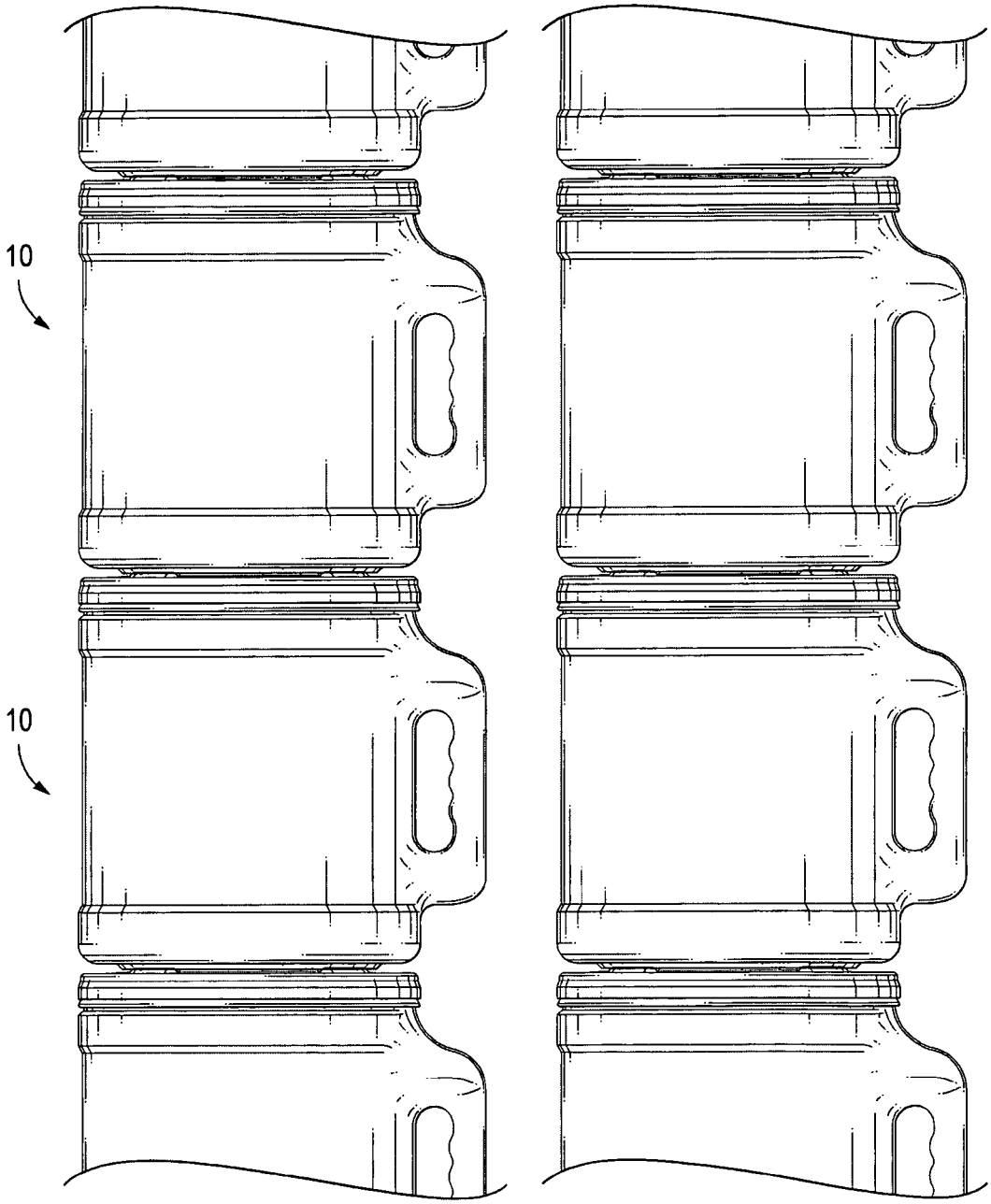
FIG. 6 is a side elevation of a stack of absorbent towel dispenser units.

FIG. 6 shows two adjacent vertical stacks of the dispenser units that may be received in packing boxes for storage, shipment and display. Packing boxes (not shown) can be so manufactured that once the boxes reach the point of sale, the sides of the boxes can be cut-down to create a display cases for the product. It is desirable to stabilize the displayed stacks of dispenser units so that the products do not topple.

Figure 7:
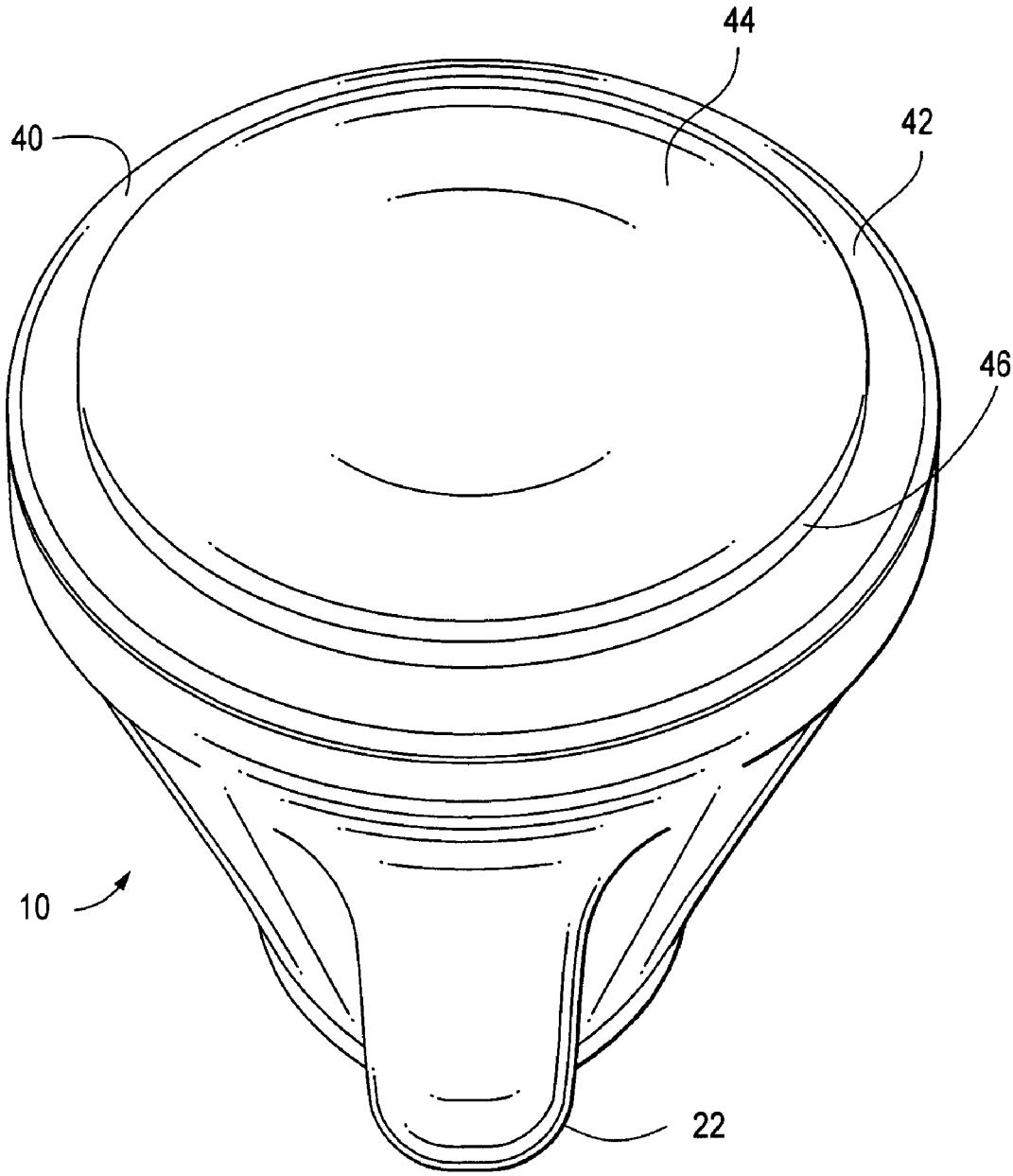
FIG. 7 is a bottom perspective view of the dispenser unit shown in FIG. 1.

FIG. 7 is a bottom perspective view of an embodiment of the dispenser 10. The bottom surface 40 includes an annular, outer shoulder 42 that is recessed relative to an inner portion 44, the inner portion and the shoulder being joined by a wall defining an annular edge 46. When dispenser units are vertically stacked, as shown in FIG. 8, the edges 46 of the units engage the inner edges 48 of ridge segments 34 on the lid 20 of a lower unit to thus form interlocks between vertically adjacent dispensers in a stack to stabilize the stack.

Figure 8:
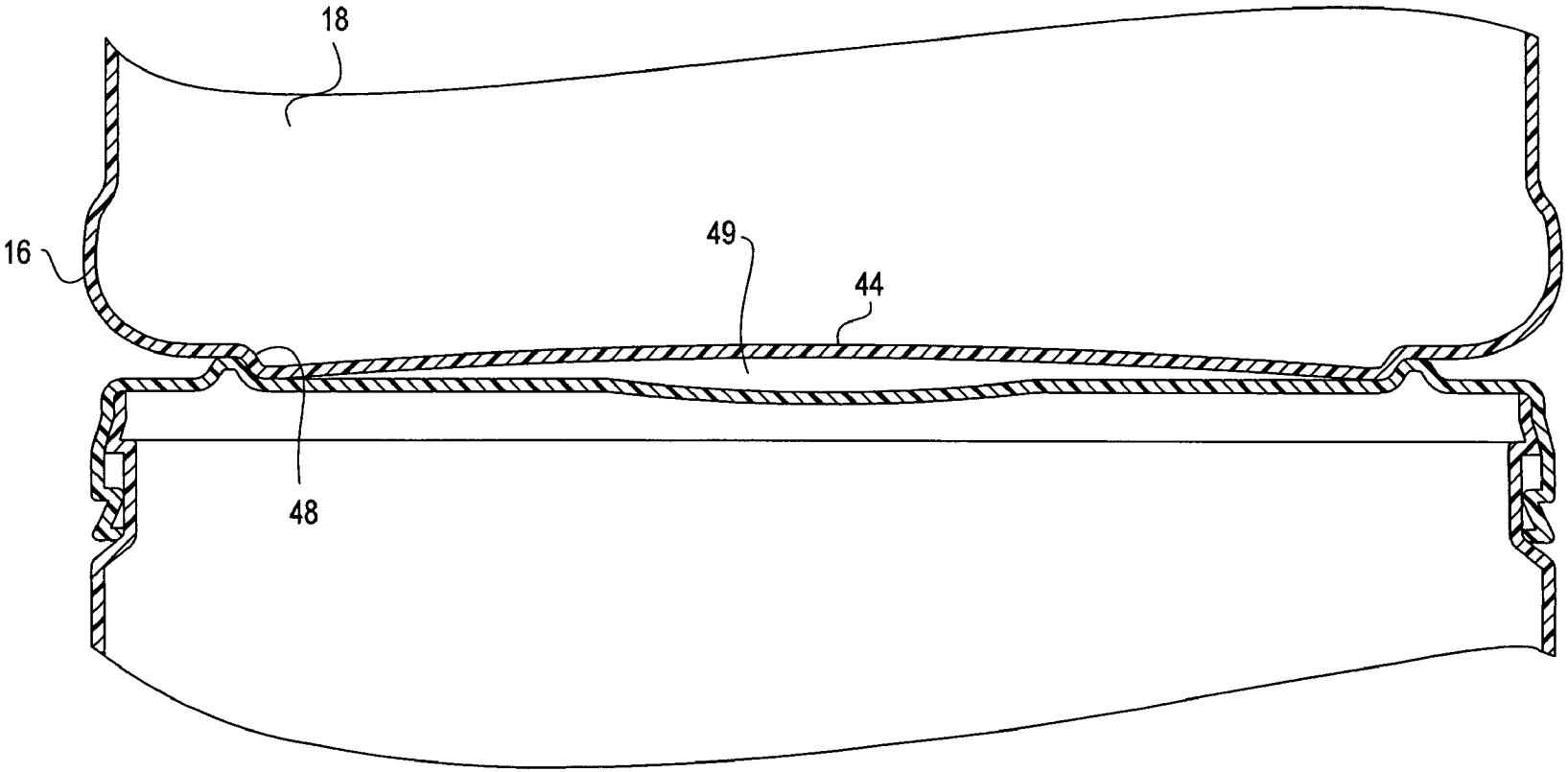
FIG. 8 is a cross sectional view of an interface between two rows of dispenser units shown in FIG. 6.
Figure 8A:
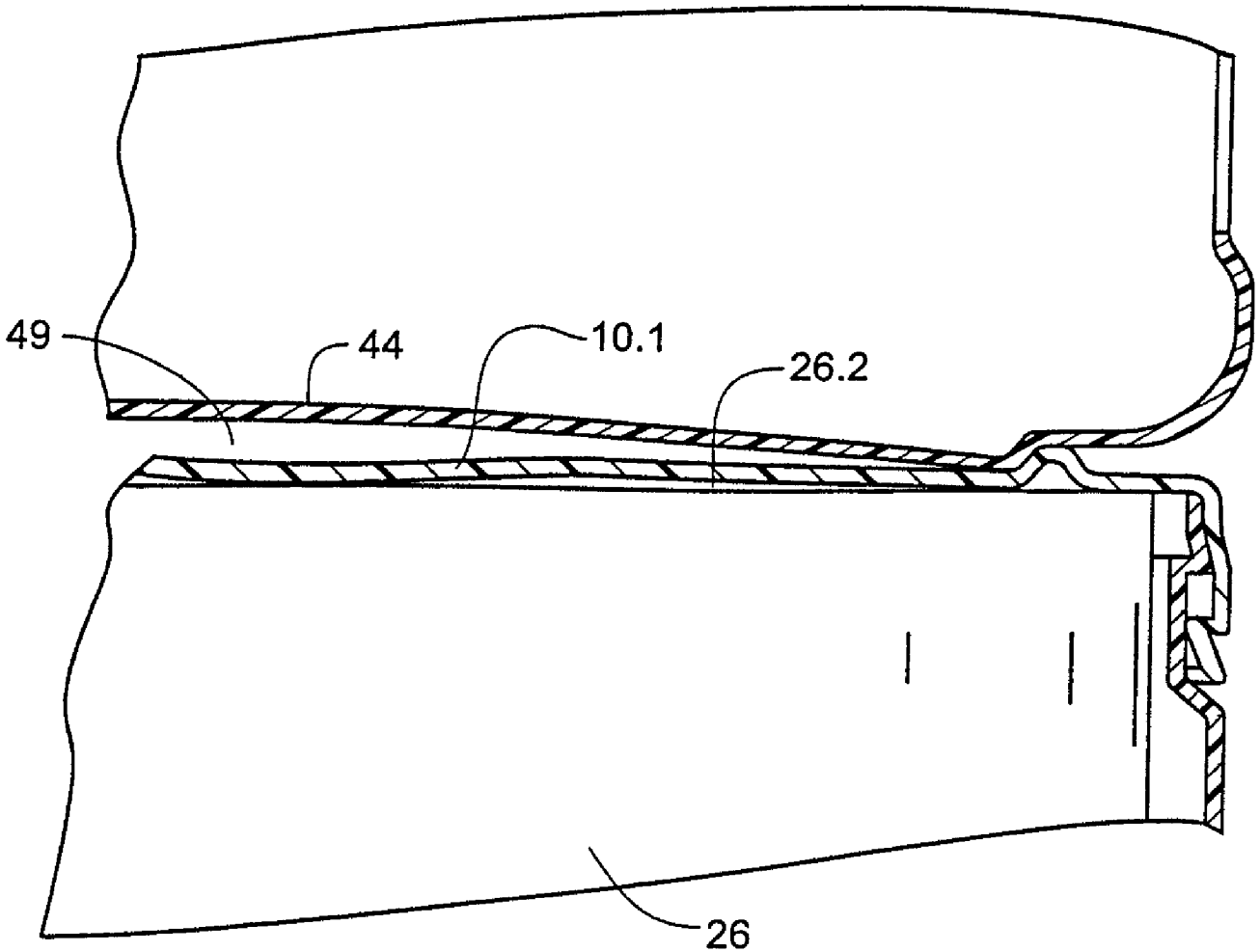
FIG. 8*a* is a broken-away view on partial cross-section showing interaction between the top wall and a towel roll in an embodiment of the invention.
Figure 8B:
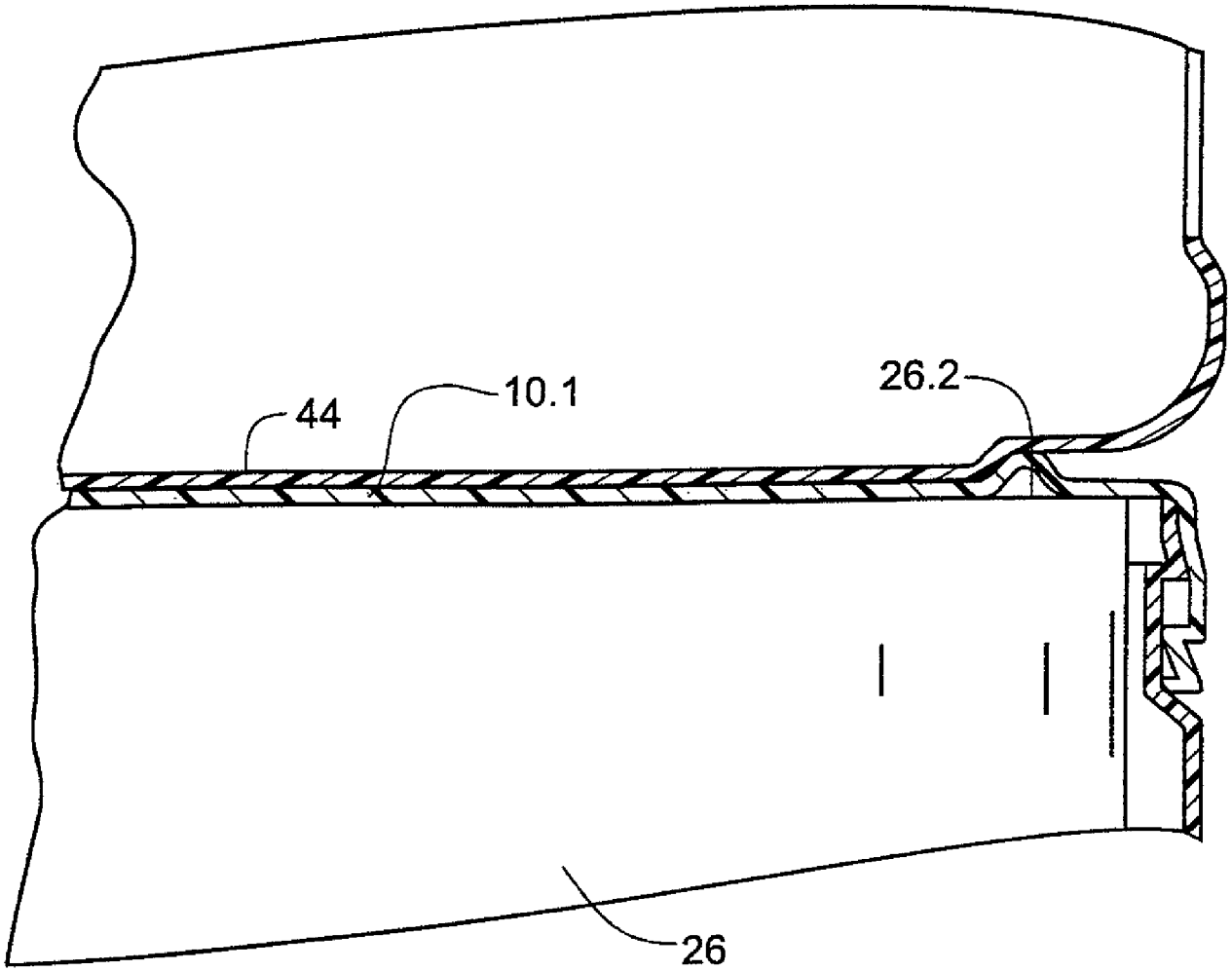
FIG. 8*b* is a broken-away view in partial cross-section showing interaction between the top wall and a towel roll in an embodiment if the invention.

As is further depicted in FIG. 8, the lid 20 is constructed of a lightweight, flexible material so that the weight of the upper dispenser 10 depresses the lid 20 to flatten (for example, reduce angle θ closer to 0 degrees) the upper surface against the top of the web roll to provide a level, strong, and thus, stable base for the upper dispenser 10. The lid, when not bearing the weight of another dispenser unit, may have the convex shape discussed above to restrain moisture and debris from moving into the opening 26, but is depressed downward elastically to generally flatten against the surface of the internal web roll top end when another unit is stacked on top of it. Further, as can be seen, the bottom shoulder 42 of the upper dispenser 10 may rest on the top most portions of the ridges 34 on the lid 20 of the lower dispenser so that a space 49 may be created in the interface between the two dispensers.

Figure 9:
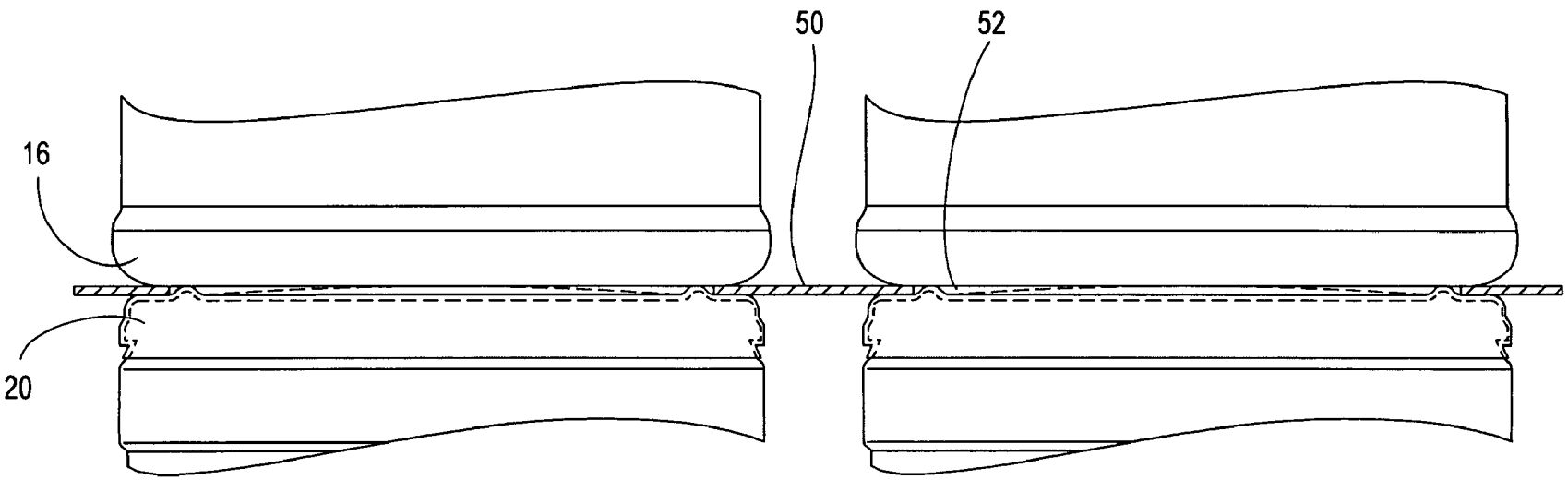
FIG. 9 is a cut away side view of stack of dispensers separated by a tie sheet.

FIG. 9 is cut-away side elevation view of two adjacent stacks of dispenser units as they may be packaged in a box. A flexible tie sheet 50 may be provided at the interfaces 52 between each vertically adjacent unit, the tie sheet 50 being constructed of a lightweight material such as paperboard, cardboard, or plastic and serving to stabilize adjacent stacks of units with respect to each other. Tie sheets 50 may include cut-outs (not visible in this view) so as not to extend across the entire interface 52. Rather, cut-outs, sized and shaped to accommodate the dispenser lid 20 and bottom surface, are provided so that the tie sheets 50 do not contact the entire surfaces of the dispenser units 10.

More particularly, in some embodiments the tie sheet, lid 20 and bottom portion 16 are constructed such that the tie sheet 50 extends between the upper and lower dispenser to approximately the outside edge of the ridges 34 on the lid 20. As can be seen, the bottom portion 16 curves upwardly thus allowing the tie sheet to extend somewhat underneath the dispenser. Similarly, the outside perimeter 38 of the lid 20 is curved downward. In addition, the lid includes ridges 34 that extend above the upper most surface of the lid to engage the bottom surface of the adjacent dispenser, thus, providing the open space into which the tie sheet extends. The ridges can be formed of a particular height corresponding to the thickness of the tie sheet so that the tie sheet 50 is snugly held between two adjacent dispensers. In the embodiment shown, the height of the ridges 34 and the thickness of the tie sheet is approximately 0.13 inches. However, those skilled in the art will recognize that either dimension can be altered without departing from the scope of the invention. It can be seen that dispensers constructed in this fashion sandwich the tie sheet 50.

While preferred embodiments have been described, it should be understood that various changes, adaptations, and modifications may be made without departing from the spirit and the scope of the appended claims.

The invention claimed is:

1. A disposable towel dispensing unit comprising a water-resistant container having bottom, top and side walls and having a manually graspable exterior handle enabling the unit to be held upright by the handle, and a roll of dry, disposable towels carried within the container, the roll having a vertically oriented axis, said top wall being vertically movable to enable it to be depressed into a position in which it is supported by said roll of towels upon application of an exterior force, said side walls and said toweling roll sharing said exterior force, the container having an opening in its top wall providing finger access to towels in the interior of the container, said top wall and bottom wall having exterior surfaces with respective nesting configurations comprising ridges formed on the exterior surface of the top wall and a ridge-receiving recess formed on the exterior surface of the bottom wall facilitating stable vertical stacking of a plurality of said containers, said ridges extending circumferentially of said opening, the ridges having interruptions in them forming channels through which water may flow in a direction away from the opening.

2. The disposable towel dispensing unit of claim 1 wherein said ridges extend circumferentially of said opening, the ridges having interruptions in them forming channels through which water may flow in a direction away from the opening.

* * * * *